US009818351B2

(12) United States Patent
Chang et al.

(10) Patent No.: US 9,818,351 B2
(45) Date of Patent: Nov. 14, 2017

(54) LIQUID CRYSTAL DEVICES

(71) Applicant: Shenzhen China Star Optoelectronics Technology Co., Ltd., Shenzhen, Guangdong (CN)

(72) Inventors: Tien-hao Chang, Guangdong (CN); Siyang Liu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 101 days.

(21) Appl. No.: 14/787,042

(22) PCT Filed: Sep. 23, 2015

(86) PCT No.: PCT/CN2015/090329

§ 371 (c)(1),
(2) Date: Oct. 26, 2015

(87) PCT Pub. No.: WO2017/020409

PCT Pub. Date: Feb. 9, 2017

(65) Prior Publication Data

US 2017/0162138 A1 Jun. 8, 2017

(30) Foreign Application Priority Data

Aug. 3, 2015 (CN) ..... 2015 1 0484012

(51) Int. Cl.
*G09G 3/36* (2006.01)

(52) U.S. Cl.
CPC ..... *G09G 3/3607* (2013.01); *G09G 3/3688* (2013.01); *G09G 2300/0443* (2013.01); *G09G 2300/0452* (2013.01); *G09G 2310/0243* (2013.01); *G09G 2320/0247* (2013.01)

(58) Field of Classification Search
CPC ..... G09G 3/20; G09G 3/36; G09G 3/3614; G09G 3/2003; G09G 3/3677; G09G 3/3688; G09G 2300/0452; G09G 2320/0247
See application file for complete search history.

(56) References Cited

U.S. PATENT DOCUMENTS

2008/0094530 A1* 4/2008 Ina ..... G02F 1/1345 349/39
2011/0242065 A1* 10/2011 Hsu ..... G09G 3/006 345/204
2012/0098871 A1* 4/2012 Park ..... G09G 3/3607 345/690
2014/0232624 A1* 8/2014 Kim ..... G09G 3/3696 345/87
2016/0035288 A1* 2/2016 Chu Ke ..... G09G 3/207 345/690

* cited by examiner

*Primary Examiner* — Md Saiful A Siddiqui
(74) *Attorney, Agent, or Firm* — Andrew C. Cheng

(57) ABSTRACT

A LCD includes the sub-pixels arranged at least in two adjacent rows. The sub-pixels of the same color are interleaved with each other along the column direction. When the LCD displays a pure color frame, within the even-number arranging periods of the sub-pixels arranged along the column direction, a number of the sub-pixels of the same color being applied with the data signals having positive polarity are the same with the sub-pixels of the same color being applied with the data signals having negative polarity. In this way, the common electrode coupling caused by the transition of the data signals may be avoided. This eliminates the flicker issues and enhances the display performance of the LCD.

14 Claims, 2 Drawing Sheets

LIQUID CRYSTAL DEVICES

CROSS REFERENCE TO RELATED APPLICAITONS

This is a national stage of PCT Application Number PCT/CN2015/090329, filed on Sep. 23, 2015, claiming foreign priority of Chinese Patent Application Number 201510484012.0, filed on Aug. 3, 2015.

BACKGROUND OF THE INVENTION

1. Field of the Invention

The present disclosure relates to liquid crystal display technology, and more particularly to a liquid crystal device (LCD).

2. Discussion of the Related Art

LCDs typically are characterized by attributes including low power consumption, low radiation, and low manufacturing cost, and thus have been widely adopted in a variety of electronic devices, such as TVs, cellular phones, digital cameras, and wearing devices. RGBW display technology of Thin Film Transistor Liquid Crystal Display (TFT-LCD) is popular due to high transmission rate and high brightness.

Currently, the LCDs display grayscale by driving the rotation of the liquid crystal molecules. Usually, positive and negative inversion methods are adopted, and dot inversion or column inversion are common polarity-inversion methods of sub-pixel array. However, the data voltage polarity outputted by adjacent data lines are opposite to each other, which results in that the polarity of the sub-pixels of the adjacent rows are inverse. When displaying by RGBW colors, data transient may cause serious Vcom coupling. At the same time, flick issues may occur due to the polarity of the sub-pixels having the same colors are the same, which greatly affects the display performance of the LCDs.

In view of the above, the inversed data signals polarity outputted by the adjacent data lines are unable to satisfy the requirement of the RGBW LCDs.

SUMMARY

The object of the invention is to provide a LCD avoiding the Vcom coupling and eliminating the flicker issue so as to enhance the display performance.

In one aspect, a liquid crystal display (LCD) includes: a plurality of sub-pixels defined by a matrix along a column direction and a row direction, and a plurality of data lines arranged along the column direction, the data lines are configured for applying data signals to the sub-pixels in two lateral columns of the data lines along the row direction in an interleaved way, each of the sub-pixel rows comprising sub-pixels of even-number of colors arranged periodically, with respect to the sub-pixels comprising red sub-pixels, green sub-pixels, blue sub-pixels, and white sub-pixels, the sub-pixels in two adjacent rows, the sub-pixels of the same color are interleaved for one or three columns along the column direction, when the LCD displays a pure color frame, within the even-number arranging periods of the sub-pixels arranged along the column direction, a number of the sub-pixels of the same color being applied with the data signals having positive polarity is the same with the sub-pixels of the same color being applied with the data signals having negative polarity.

Wherein with respect to the sub-pixels of the same color in two adjacent columns, the sub-pixels interleaved for one row are respectively applied with the data signals by the data lines between the two sub-pixels.

Wherein with respect to the sub-pixels of the same color in two adjacent columns, the sub-pixels interleaved for one row are respectively applied with the data signals by the data lines at two lateral sides of the sub-pixels.

Wherein with respect to the even-number arranging periods of the sub-pixels arranged along the column direction, the data signals polarity of a portion of the adjacent sub-pixels within each of the arranging period is the same, within different arranging periods, the data signals polarity of a portion of the adjacent sub-pixels are opposite to each other.

Wherein the LCD further comprises a data driver comprises a plurality of output ports corresponding to the data lines, and the number of the output ports is the same with the number of the data lines, the data signals polarity of each of the output port is opposite to that of the adjacent output port, within the even-number of arranging periods along the column direction, the data lines corresponding to a portion of the sub-pixels connect to the output ports in a direct way, and the data lines corresponding to other sub-pixels connect to the output ports in a cross way.

Wherein with respect to the direct way, the n-th data line among the data lines and the n-th charging port of the data driver are connected, and with respect to the cross way, the i-th data line among the data lines and the (i+j)-th or the (i−j)-th output port ($K_{i+j}$) of the data driver are connected, wherein n and i are positive integers different from each other, and j is an odd number.

Wherein the sub-pixel of even-number of colors comprises the sub-pixel of four colors, and the even-number arranging periods comprises two arranging periods, wherein within the two arranging periods, the data signals polarity of the n-th sub-pixel is opposite to that applied by the (n+4)-th sub-pixel, wherein n is a positive integer larger than or equals to one and is smaller than or equals to four.

Wherein the data signals polarity of the sub-pixels within the two arranging periods are positive, negative, positive, positive, negative, positive, negative and negative, or negative, positive, positive, negative, positive, negative, negative and negative.

In another aspect, a LCD includes: a plurality of sub-pixels defined by a matrix along a column direction and a row direction, and a plurality of data lines arranged along the column direction the data lines are configured for applying data signals to the sub-pixels in two lateral columns of the data lines along the row direction in an interleaved way, each of the sub-pixel rows comprising sub-pixels of even-number of colors arranged periodically, with respect to the sub-pixels in two adjacent rows, the sub-pixels of the same color are interleaved with each other along the column direction, when the LCD displays a pure color frame, within the even-number arranging periods of the sub-pixels arranged along the column direction, a number of the sub-pixels of the same color being applied with the data signals having positive polarity is the same with the sub-pixels of the same color being applied with the data signals having negative polarity.

Wherein with respect to the sub-pixels in two adjacent rows, the sub-pixels of the same color are interleaved for one or three columns along the column direction.

Wherein with respect to the sub-pixels of the same color in two adjacent columns, the sub-pixels interleaved for one row are respectively applied with the data signals by the data lines between the two sub-pixels.

Wherein with respect to the sub-pixels of the same color in two adjacent columns, the sub-pixels interleaved for one row are respectively applied with the data signals by the data lines at two lateral sides of the sub-pixels.

Wherein with respect to the even-number arranging periods of the sub-pixels arranged along the column direction, the data signals polarity of a portion of the adjacent sub-pixels within each of the arranging period is the same, within different arranging periods, the data signals polarity of a portion of the adjacent sub-pixels are opposite to each other.

Wherein the LCD further comprises a data driver comprising a plurality of output ports corresponding to the data lines, and the number of the output ports is the same with the number of the data lines, the data signals polarity of each of the output port is opposite to that of the adjacent output port, within the even-number of arranging periods along the column direction, the data lines corresponding to a portion of the sub-pixels connect to the output ports in a direct way, and the data lines corresponding to other sub-pixels connect to the output ports in a cross way.

Wherein with respect to the direct way, the n-th data line among the data lines and the n-th charging port of the data driver are connected, and with respect to the cross way, the i-th data line among the data lines and the (i+j)-th or the (i−j)-th output port ($K_{i+j}$) of the data driver are connected, wherein n and i are positive integers different from each other, and j is an odd number.

Wherein the sub-pixel of even-number of colors comprises the sub-pixel of four colors, and the even-number arranging periods comprises two arranging periods, wherein within the two arranging periods, the data signals polarity of the n-th sub-pixel is opposite to that applied by the (n+4)-th sub-pixel, wherein n is a positive integer larger than or equals to one and is smaller than or equals to four.

Wherein the data signals polarity of the sub-pixels within the two arranging periods are positive, negative, positive, positive, negative, positive, negative and negative, or negative, positive, positive, negative, positive, negative, negative and negative.

Wherein the sub-pixels of even-number colors comprises red sub-pixels, green sub-pixels, blue sub-pixels, and white sub-pixels.

In view of the above, with respect to the sub-pixels arranged at least in two adjacent rows, the sub-pixels of the same color are interleaved with each other along the column direction. When the LCD displays a pure color frame, within the even-number arranging periods of the sub-pixels arranged along the column direction, a number of the sub-pixels of the same color being applied with the data signals having positive polarity is the same with the sub-pixels of the same color being applied with the data signals having negative polarity. In this way, the common electrode coupling caused by the transition of the data signals may be avoided. This eliminates the flicker issues and enhances the display performance of the LCD.

DETAILED DESCRIPTION OF THE EMBODIMENTS

Embodiments of the invention will now be described more fully hereinafter with reference to the accompanying drawings, in which embodiments of the invention are shown.

Figure 1:
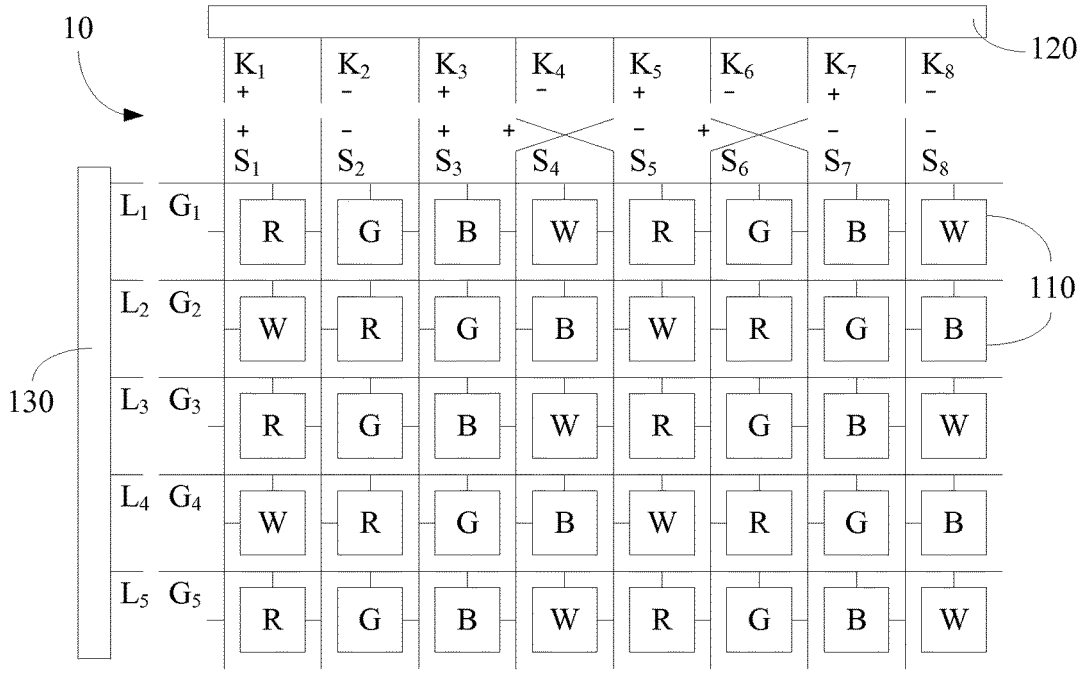
FIG. 1 is a schematic view of the pixel structure of the LCD in accordance with one embodiment.

FIG. 1 is a schematic view of the pixel structure of the LCD in accordance with one embodiment. The LCD 10 includes a plurality of sub-pixels 110 defined by a matrix along a column direction and a row direction, a plurality of data lines arranged along the column direction, and a plurality of scanning lines arranged along the row direction. The data lines are configured for applying data signals to corresponding columns of sub-pixels 110. The scanning lines are configured for applying scanning signals to the corresponding columns of sub-pixels 110 to turn on the sub-pixels 110 in each of the columns and to receive the data signals of the corresponding data lines. FIG. 1 is an example showing the LCD 10 having the sub-pixels 110 arranged in five rows and in eight columns, wherein $G_n$ represents the scanning line connected by the sub-pixels 110 in the n-th row, $S_n$ represents the n-th data line, and n is a positive integer. The sub-pixels 110 in each of the rows includes the sub-pixels 110 having periodically arranged sub-pixels 110 having even numbers of colors. When the LCD 10 displays a purely color frame, an even number of arranging periods having the sub-pixels 110 of different colors are arranged along the row direction. Regarding the sub-pixels 110 having the same color, the number of the sub-pixels 110 being applied with the data signals having positive polarity is the same with that being applied with the data signals having negative polarity.

Referring to FIG. 1, the sub-pixels 110 include four kinds of colors, which are respective red sub-pixel (hereinafter referred to as R sub-pixel), green sub-pixel (hereinafter referred to as R sub-pixel), blue sub-pixel (hereinafter referred to as B sub-pixel), and white sub-pixel (hereinafter referred to as W sub-pixel). The R sub-pixel, the G sub-pixel, the B sub-pixel, and the white photon sub-pixel row (W) are arranged periodically and thus two arranging periods are shown. The sub-pixels 110 in the odd-th rows, such as the 1-th row and the 3-th row, include the R sub-pixel, the G sub-pixel, the B sub-pixel, and the W sub-pixel arranged periodically. The sub-pixels 110 in the even-th rows, such as the 2-th row and the 4-th row, include the W sub-pixel, the R sub-pixel, the G sub-pixel, and the B sub-pixel arranged periodically. Each of the data lines connects to one corresponding row of sub-pixels 110. In other embodiments, the sub-pixels in the odd-th rows may be arranged in the sequence of W sub-pixel, the R sub-pixel, the G sub-pixel, and the B sub-pixel, and the sub-pixels in the even-th rows may be arranged in the sequence of R sub-pixel, G sub-pixel, B sub-pixel, and W sub-pixel.

With respect to the sub-pixels 110 in two adjacent rows along the column direction, the sub-pixels 110 having the same color may be interleaved for one or three columns. As shown in FIG. 1, from the left end to the right end, The R sub-pixel in the first row and in the first column is interleaved with the R sub-pixel in the second column and in the second row along the column direction. The R sub-pixel in the second column and in the second row is spaced apart from the R sub-pixel in the third column and the fifth row for three columns.

With respect to the sub-pixels 110 in two adjacent columns along the row direction, the sub-pixels 110 of the same color and is spaced apart for one row are respectively applied with the data signals by the data line between the two sub-pixels 110. For instance, the R sub-pixel in the first column and the first row and the R sub-pixel in the second column and the second row are respectively applied with the data signals by the second data line ($S_2$).

Referring to FIG. 1, the even-number arranging periods, in an example, may be two arranging periods. Within the two arranging periods, the data signals polarity of the n-th sub-pixel 110 is opposite to that applied by the (n+4)-th sub-pixel 110, wherein n is a positive integer larger than or equals to one and is smaller than or equals to four. For instance, from the left end to the right end, the data signals polarity of the first data line ($S_1$), the second data line ($S_2$), the third data line ($S_3$), the fourth data line ($S_4$), the fifth data line ($S_5$), the sixth data line ($S_6$), the seventh data line ($S_7$), and the eighth data line ($S_8$) are respectively positive (+), negative (−), positive (+), positive (+), negative (−), positive (+), negative (−), and negative (−).

Within the two arranging periods of the sub-pixels 110 arranged along the column direction, the data signals polarity of a portion of the adjacent sub-pixels 110 within each of the arranging period is the same. Within different arranging periods, the data signals polarity of a portion of the adjacent sub-pixels 110 are opposite to each other. For instance, the B sub-pixel in the first row and in the third column and the W sub-pixel in the first row and in the fourth column are within the same arranging period, and the two sub-pixels are adjacent to each other. The polarity of the data signals respectively received from the fourth data line ($S_4$) and the fifth data line ($S_5$) are the same. The W sub-pixel in the first row and in the fourth column and the R sub-pixel in the first row and in the fifth column are within different arranging periods, and the two sub-pixels are adjacent to each other. The polarity of the data signals respectively received from the fourth data line ($S_5$) and the fifth data line ($S_6$) are opposite to each other.

Within the two arranging periods having the R sub-pixel, the G sub-pixel, the B sub-pixel, and the W sub-pixel periodically arranged along the column direction, the data signals polarity of the second data line ($S_2$) and the sixth data line ($S_6$) are opposite to each other. As such, the data signals polarity of the R sub-pixel in the first column and that of the R sub-pixel in the fifth column are opposite to each other. In this way, the number of the R sub-pixels in the first column being applied with the data signals having positive polarity is the same with that in the fifth column being applied with the data signals having negative polarity. Similarly, the data signals polarity of the third data line ($S_3$) and that of the seventh data line ($S_7$) are opposite to each other, and thus the data signals polarity of the G sub-pixel in the second column is opposite to that of the G sub-pixel in the sixth column. In this way, the number of the G sub-pixels in the sixth column being applied with the data signals having positive polarity is the same with that in the second column being applied with the data signals having negative polarity. The data signals polarity of the fourth data line ($S_4$) and that of the eighth data line ($S_8$) are opposite to each other, and thus the data signals polarity of the B sub-pixel in the third column is opposite to that of the B sub-pixel in the seventh column. In this way, the number of the B sub-pixels in the third column being applied with the data signals having positive polarity is the same with that in the seventh column being applied with the data signals having negative polarity. The data signals polarity of the fifth data line ($S_5$) and that of the first data line ($S_1$) are opposite to each other, and thus the data signals polarity of the W sub-pixel in the fourth column is opposite to that of the W sub-pixel in the eighth column. In this way, the number of the W sub-pixels in the eighth column being applied with the data signals having positive polarity is the same with that in the fourth column being applied with the data signals having negative polarity.

In the embodiment, among the sub-pixels 110 of the same color, the number of the sub-pixels 110 being applied with the data signals having positive polarity is the same with that in the second column being applied with the data signals having negative polarity. That is, when the LCD 10 displays the pure color frame, half of the data signals polarity of the sub-pixels 110 of the same color are positive, and half of the data signals polarity of the sub-pixels 110 of the same color are negative. As such, when the sub-pixels 110 perform grayscale displaying when being driven by row inversion or column inversion, the common electrode coupling caused by the transition of the data signals may be avoided. This eliminates the flicker issues and enhances the display performance of the LCD 10. The row inversion method will be taken as one example to illustrate FIG. 1 and the below.

Figure 2:
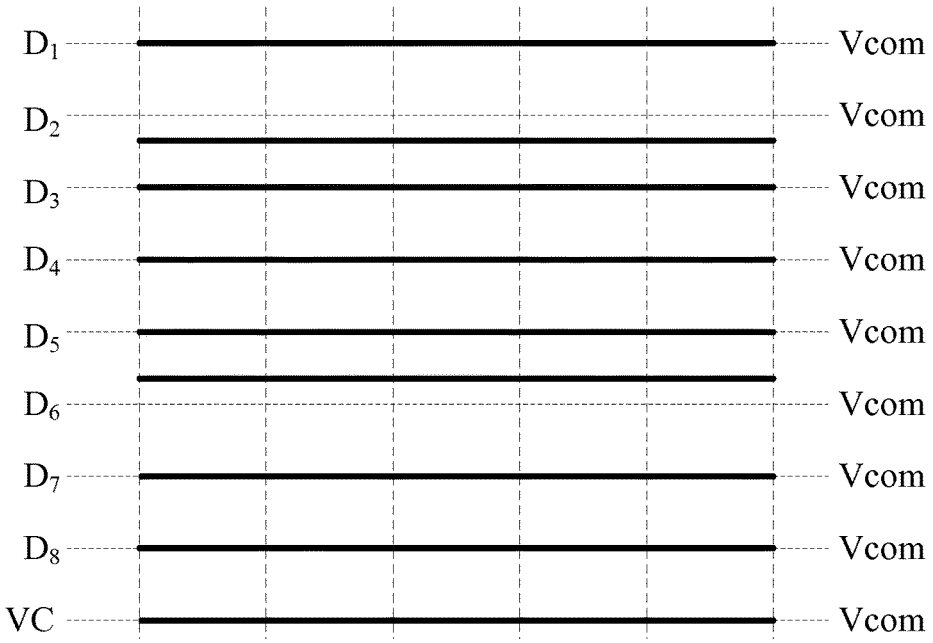
FIG. 2 is a schematic view of the time sequence of the data signals when the LCD of FIG. 1 displays a purely red frame.

FIG. 2 is a schematic view of the time sequence of the data signals when the LCD of FIG. 1 displays a purely red frame. As shown in FIG. 2, when the LCD 10 displays a pure color frame, each of the data lines apply the data signals toward the corresponding rows of sub-pixels 110, which is represented by "the n-th data line ($S_n$) applies the data signals ($D_n$), and wherein the data line D(n) is substantially the electronic signals. In addition, the polarity is positive when the voltage is larger than the common electrode voltage of the sub-pixel 110, and the polarity is negative wh. Specifically, when the purely red frame is displayed, the polarity of the data signals ($D_2$) of the second data line ($S_2$) is opposite to that of the data signals ($D_6$) of the sixth data line ($S_2$). As such, the polarity of the data signals ($D_2$) of the R sub-pixel in the first column is opposite to that of the data signals ($D_6$) of the R sub-pixel in the fifth column. As the other data lines display corresponding colors, and thus the data signals applied by other data lines are the same with the common electrode (Vcom). At this moment, half of the data signals polarity of the R sub-pixel is positive, and half of the data signals polarity of the R sub-pixel is negative, the common electrode coupling caused by the transition of the data signals may be avoided. In FIG. 2, VC represents the coupling signals of common electrode. The flicker issues are eliminated and the display performance of the LCD 10 is enhanced. Similarly, when other pure color, such as green, blue, white, or any colors formed by the above colors, half of the data signals polarity of the R sub-pixel, the G sub-pixel, the B sub-pixel, or the W sub-pixel is positive, and half of the data signals polarity of the R sub-pixel, the G sub-pixel, the B sub-pixel, or the W sub-pixel is negative. The common electrode coupling caused by the transition of the data signals may be avoided. This eliminates the flicker issues and enhances the display performance of the LCD 10.

Referring to FIG. 1, the LCD 10 also includes a data driver 120 and a scanning driver 130. The scanning driver 130 includes a plurality of charging ports corresponding to the scanning lines, and the number of the charging ports is the same with the number of the scanning lines. The data driver 120 includes a plurality of output ports corresponding to the data lines, and the number of the output ports is the same with the number of the data lines. In FIG. 1, five charging ports and eight output ports are shown, wherein $L_n$ represent the n-th charging port, the corresponding scanning line of the sub-pixel 110 connects to the charging port in a direct way. $K_n$ represents the n-th output port, the data signals polarity of each of the output port is opposite to that of the adjacent output port. Within the even-number of arranging periods along the column direction, the data lines corresponding to a portion of the sub-pixels 110 connect to the output ports in a direct way, and the data lines corresponding to other sub-pixels 110 connect to the output ports in a cross way.

The direct way relates to connecting the n-th data line ($G_n$) of the scanning driver 130 and the n-th charging port ($L_n$) of the data driver 120. The cross way relates to connecting the i-th data line ($S_i$) among the data lines and the (i+j)-th output port ($K_{i+j}$) of the data driver 120 or the (i−j)-th output port ($K_{i-j}$), wherein n and i are positive integers different from each other, and j is an odd number.

With respect to the two arranging periods in FIG. 1, the first data line ($D_1$), the second data line ($D_2$), the third data line ($D_3$) and the eighth data line ($D_8$) connect to the output port ($K_1$, $K_2$, $K_3$, $K_3$) in the direct way. The fourth data line ($D_4$), the fifth data line ($D_5$), the sixth data line ($D_6$) and the seventh data line ($D_7$) connect to the output port ($K_5$, $K_4$, $K_7$, $K_6$) in the cross way, wherein j equals to one. It can be understood the data lines and the output ports may be connected in other ways, and j is a positive odd-number not limited to one. The connections between the data lines and the output ports may be configured in accordance with the arranging period and the value of j.

Figure 3:
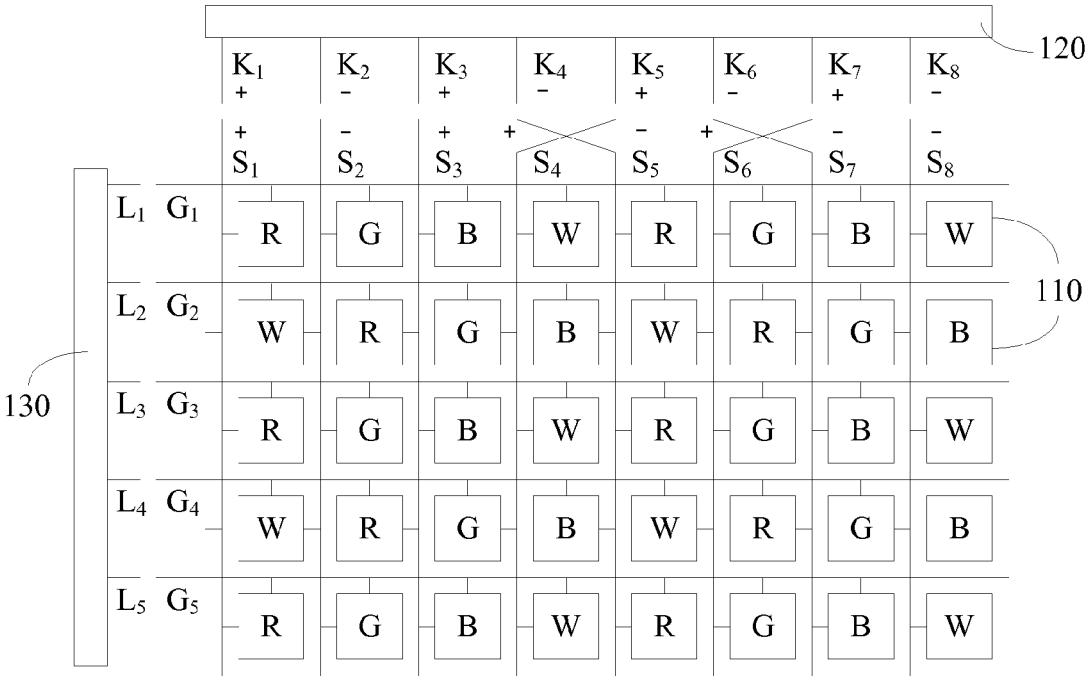
FIG. 3 is a schematic view of the pixel structure of the LCD in accordance with another embodiment.

FIG. 3 is a schematic view of the pixel structure of the LCD in accordance with another embodiment. As shown in FIG. 3, the components which are the same with that in FIG. 1 are labeled by the same reference numerals. The difference between FIGS. 1 and 3 resides in that the two rows of sub-pixels 110 arranged along the row direction, two adjacent sub-pixels 110 of the same color are applied with the data signals by the data lines at two sides of the sub-pixels 110. For instance, from the left end to the right end, the R sub-pixel in the first row and in the first column and the R sub-pixel in the second row and the second column are spaced apart from each other for one row. The R sub-pixel in the first row and in the first column is applied with the data signals by the first data line ($S_1$), and the R sub-pixel in the second row and in the second column is applied with the data signals by the third data line ($S_3$). The data line ($S_1$) and the data line ($S_3$) are at two lateral sides of the two R sub-pixels.

The two arranging periods arranged along the column direction respectively include the R sub-pixel, the G sub-pixel, the B sub-pixel, and the W sub-pixel periodically arranged. The data signals polarity of the first data line ($S_1$) is opposite to that of the data line ($S_5$) such that the data signals polarity of the R sub-pixel in the first column is opposite to that of the R sub-pixel in the fifth column such that the data signals polarity of the R sub-pixel in the first column is opposite to that of the R sub-pixel in the fifth column. In this way, regarding the sub-pixels having the same color, the number of the sub-pixels in the first column being applied with the data signals having positive polarity is the same with the sub-pixels in the fifth column being applied with the data signals having negative polarity. Similarly, the data signals polarity of the second data line ($S_2$) and that of the sixth data line ($S_6$) are opposite to each other, and thus the data signals polarity of the G sub-pixel in the second column is opposite to that of the G sub-pixel in the sixth column. In this way, the number of the G sub-pixels in the sixth column being applied with the data signals having positive polarity is the same with that in the second column being applied with the data signals having negative polarity. The data signals polarity of the third data line ($S_3$) and that of the seventh data line ($S_7$) are opposite to each other, and thus the data signals polarity of the B sub-pixel in the third column is opposite to that of the B sub-pixel in the seventh column. In this way, the number of the B sub-pixels in the third column being applied with the data signals having positive polarity is the same with that in the seventh column being applied with the data signals having negative polarity. The data signals polarity of the fourth data line ($S_4$) and that of the eighth data line ($S_8$) are opposite to each other, and thus the data signals polarity of the W sub-pixel in the fourth column is opposite to that of the W sub-pixel in the eighth column. In this way, the number of the W sub-pixels in the eighth column being applied with the data signals having positive polarity is the same with that in the fourth column being applied with the data signals having negative polarity.

Figure 4:
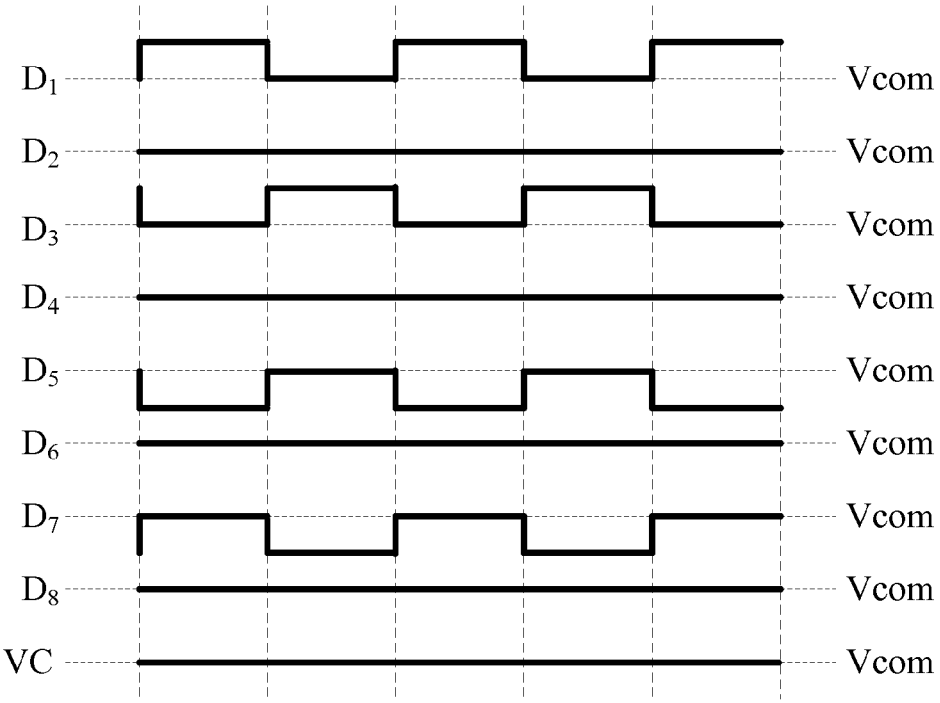
FIG. 4 is a schematic view of the time sequence of the data signals when the LCD of FIG. 3 displays a purely red frame.

FIG. 4 is a schematic view of the time sequence of the data signals when the LCD of FIG. 3 displays a purely red frame. As shown in FIG. 3, when the LCD displays a pure red frame, the polarity of the data signals ($D_1$) on the first data line ($S_1$) is opposite to that of the data signals ($D_5$) on the fifth data line ($D_5$) such that the polarity of the data signals ($D_1$) applied on the R sub-pixel in the first column is opposite to that of the data signals ($D_5$) applied on the R sub-pixel in the fifth column. In addition, the polarity of the data signals ($D_3$) on the third data line ($S_3$) is opposite to that of the data signals ($D_7$) on the seven data line ($S_7$) such that the data signals ($D_3$) applied on the R sub-pixel in the third column is opposite to that applied on the R sub-pixel in the seventh column.

As the other data lines display corresponding colors, and thus the data signals applied by other data lines are the same with the common electrode (Vcom). At this moment, half of the data signals polarity of the R sub-pixel is positive, and half of the data signals polarity of the R sub-pixel is negative, the common electrode coupling caused by the transition of the data signals may be avoided. The flicker issues are eliminated and the display performance of the LCD 10 is enhanced.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal display (LCD), comprising:

a plurality of sub-pixels defined by a matrix along a column direction and a row direction, a plurality of data lines arranged along the column direction, and a plurality of scanning lines arranged along the row direction, the data lines are configured for applying data signals to the sub-pixels in two lateral columns of the data lines along the row direction in an interleaved way, each of the sub-pixel rows comprising sub-pixels of even-number of colors arranged periodically, with respect to the sub-pixels comprising red sub-pixels, green sub-pixels, blue sub-pixels, and white sub-pixels, the sub-pixels in two adjacent rows, the sub-pixels of the same color are interleaved for one or three columns along the column direction, when the LCD displays a pure color frame, within the even-number arranging periods of the sub-pixels arranged along the column direction, a number of the sub-pixels of the same color being applied with the data signals having positive polarity is the same with the sub-pixels of the same color being applied with the data signals having negative polarity;

wherein two sub-pixels of the same color that are interleaved for one row and one column from each other are respectively applied with the data signals by the data line arranged between the two respective sub-pixels.

2. The LCD claimed in claim 1, wherein with respect to the sub-pixels of the same color in two adjacent columns, the sub-pixels interleaved for one row are respectively applied with the data signals by the data lines at two lateral sides of the sub-pixels.

3. The LCD claimed in claim 1, wherein with respect to the even-number arranging periods of the sub-pixels arranged along the column direction, the data signals polarity of a portion of the adjacent sub-pixels within each of the arranging period is the same, within different arranging periods, the data signals polarity of a portion of the adjacent sub-pixels are opposite to each other.

4. The LCD claimed in claim 3, wherein the LCD further comprises a data driver comprising a plurality of output ports corresponding to the data lines, and the number of the output ports is the same with the number of the data lines, the data signals polarity of each of the output port is opposite to that of the adjacent output port, within the even-number of arranging periods along the column direction, the data lines corresponding to a portion of the sub-pixels connect to the output ports in a direct way, and the data lines corresponding to other sub-pixels connect to the output ports in a cross way.

5. The LCD claimed in claim 4, wherein with respect to the direct way, the n-th data line among the data lines and the n-th charging port of the data driver are connected, and with respect to the cross way, the i-th data line among the data lines and the (i+j)-th or the (i−j)-th output port ($K_{i+j}$) of the data driver are connected, wherein n and i are positive integers different from each other, and j is an odd number.

6. The LCD claimed in claim 1, wherein the sub-pixel of even-number of colors comprises the sub-pixel of four colors, and the even-number arranging periods comprises two arranging periods, wherein within the two arranging periods, the data signals polarity of the n-th sub-pixel is opposite to that applied by the (n+4)-th sub-pixel, wherein n is a positive integer larger than or equals to one and is smaller than or equals to four.

7. The LCD claimed in claim 6, wherein the data signals polarity of the sub-pixels within the two arranging periods are positive, negative, positive, positive, negative, positive, negative and negative, or negative, positive, positive, negative, positive, negative, negative and negative.

8. A LCD, comprising:

a plurality of sub-pixels defined by a matrix along a column direction and a row direction, a plurality of data lines arranged along the column direction, and a plurality of scanning lines arranged along the row direction, the data lines are configured for applying data signals to the sub-pixels in two lateral columns of the data lines along the row direction in an interleaved way, each of the sub-pixel rows comprising sub-pixels of even-number of colors arranged periodically, with respect to the sub-pixels in two adjacent rows, the sub-pixels of the same color are interleaved with each other along the column direction, when the LCD displays a pure color frame, within the even-number arranging periods of the sub-pixels arranged along the column direction, a number of the sub-pixels of the same color being applied with the data signals having positive polarity is the same with the sub-pixels of the same color being applied with the data signals having negative polarity;

wherein a first sub-pixel and a second sub-pixel of the same color that are interleaved for one row and one column from each other are respectively applied with the data signals by a first data line located at a left side of the first sub-pixel and by a second data line located at a right side of the second sub-pixel.

9. The LCD claimed in claim 8, wherein with respect to the even-number arranging periods of the sub-pixels arranged along the column direction, the data signals polarity of a portion of the adjacent sub-pixels within each of the arranging period is the same, within different arranging periods, the data signals polarity of a portion of the adjacent sub-pixels are opposite to each other.

10. The LCD claimed in claim 9, wherein the LCD further comprises a data driver comprising a plurality of output ports corresponding to the data lines, and the number of the output ports is the same with the number of the data lines, the data signals polarity of each of the output port is opposite to that of the adjacent output port, within the even-number of arranging periods along the column direction, the data lines corresponding to a portion of the sub-pixels connect to the output ports in a direct way, and the data lines corresponding to other sub-pixels connect to the output ports in a cross way.

11. The LCD claimed in claim 10, wherein with respect to the direct way, the n-th data line among the data lines and the n-th charging port of the data driver are connected, and with respect to the cross way, the i-th data line among the data lines and the (i+j)-th or the (i−j)-th output port ($K_{i+j}$) of the data driver are connected, wherein n and i are positive integers different from each other, and j is an odd number.

12. The LCD claimed in claim 8, wherein the sub-pixel of even-number of colors comprises the sub-pixel of four colors, and the even-number arranging periods comprises two arranging periods, wherein within the two arranging periods, the data signals polarity of the n-th sub-pixel is opposite to that applied by the (n+4)-th sub-pixel, wherein n is a positive integer larger than or equals to one and is smaller than or equals to four.

13. The LCD claimed in claim 8, wherein the data signals polarity of the sub-pixels within the two arranging periods are positive, negative, positive, positive, negative, positive, negative and negative, or negative, positive, positive, negative, positive, negative, negative and negative.

14. The LCD claimed in claim 8, wherein the sub-pixels of even-number colors comprises red sub-pixels, green sub-pixels, blue sub-pixels, and white sub-pixels.

* * * * *